United States Patent [19]

Westerhoff et al.

[11] 4,192,644

[45] Mar. 11, 1980

[54] COOLED GRATE FOR SUPPORTING A WORKPIECE IN AN OVEN

[76] Inventors: Heinz Westerhoff, Jakobstrasse 36; Wilhelm Riege, Brandsheide 24a, both of 4330 Mülheim, Ruhr, Fed. Rep. of Germany

[21] Appl. No.: 888,493

[22] Filed: Mar. 20, 1978

[30] Foreign Application Priority Data

Mar. 24, 1977 [DE] Fed. Rep. of Germany ..... 2713014

[51] Int. Cl.[2] ..... F27B 9/14

[52] U.S. Cl. ..... 432/122; 432/234

[58] Field of Search ..... 432/122, 123, 233, 234

[56] References Cited

U.S. PATENT DOCUMENTS

| | | | |
|---|---|---|---|
| 2,693,952 | 11/1954 | Nesbitt | 432/123 |
| 3,586,299 | 6/1971 | Foldessy | 432/234 |

*Primary Examiner*—John J. Camby

*Attorney, Agent, or Firm*—Karl F. Ross

[57] ABSTRACT

A grate is formed of a plurality of grate elements each in turn having a horizontal elongated support tube extending above and parallel to a supply tube. One end of the supply tube is connected via an upright connector tube or the corresponding end of the support tube and a plurality of posts extend vertically down from the support tube to the supply tube with their lower ends connected to the support tube. One end of the supply tube is fixed and the rest of the supply tube can move relative to its fixed end so when a heat-exchange fluid is passed through the supply tube, connector tube, and support tube the supply and support tubes will expand or contract thermally and displace the upper and lower ends of the connector tube and posts to the same extent.

10 Claims, 4 Drawing Figures

COOLED GRATE FOR SUPPORTING A WORKPIECE IN AN OVEN

FIELD OF THE INVENTION

The present invention relates to a grate. More particularly, this invention concerns a grate which may be of the traveling-beam type that is used to support a workpiece in an oven.

BACKGROUND OF THE INVENTION

A workpiece is often supported in an oven by a grate formed of a plurality of grate elements each constituted as a tube through which a heat-exchange fluid is circulated to prevent the grate elements themselves from being excessively heated and damaged.

Although normally the entire support tube of such a grate element is at substantially the same temperature due to the fluid traversing it, it is nonetheless subject to considerable temperature changes causing a large degree of thermal expansion. As these support tubes are normally supported between their ends on upright posts the result is that these posts are themselves subject to considerable bending stress as the support tubes they carry expand and contract.

It has been suggested to form a sliding joint between the upper end of each post and the respective support tube. Thus as the support tubes expand and contract they can slide relative to their posts, with only modest force transmission between the tubes and the posts. Such an arrangement is only a partial solution, in that with time the sliding joint between the post upper end the support tube offers greater and greater resistance to sliding so that, once again, the posts are subject to considerable bending stress. Furthermore such a system is completely unusable in an arrangement such as described in now abandoned U.S. Pat. application 785,681 filed 7 Apr. 1977 by Heinz WESTERHOFF where the posts themselves are also traversed by the cooling fluid, as there is no practical way to pass the fluid across the sliding joint.

In another arrangement which allows cooling of the posts the lower end of the posts are provided with roller shoes. Thus as the tube expands and contracts the roller shoes at the lower ends of the posts can move in the direction of expansion and contraction. This arrangement has the disadvantage, once again, that any resistance to displacement of the roller shoe at the bottom of the post is converted into a bending stress in the respective post. As such an arrangement is often used in a metallurgical oven or the like, fouling of the rollers is an inevitability, so that the arrangement must be serviced frequently.

OBJECTS OF THE INVENTION

It is therefore an object of the present invention to provide an improved grate element usable in a support grate for an oven.

Another object is to provide such a grate element whose thermal expansion and contraction is readily compensated for without damage to or undue stressing of the grate element.

Yet another object is to provide such an arrangement wherein the support posts for the horizontal support tube of each grate element can be cooled in the manner described in the above-cited copending application.

SUMMARY OF THE INVENTION

These objects are attained according to the present invention in a grate element having a horizontally elongated support tube having a pair of ends. A supply tube extends generally parallel to and underneath the support tube and has one end underneath one end of the support tube and another end secured rigidly to a fixed support. A connector tube extends vertically between the supply tube and the support tube at the one end thereof so that the supply, connector, and support tubes can form a circulation loop terminating at the other ends of the support and supply tubes. A heat-exchange fluid such as steam or hot water is passed through this loop between the other ends thereof. At least one support post extends vertically between the support tube and the supply tube intermediate the ends thereof so that the support tube is fully supported via these posts on a supply tube. Finally the supply tube is supported except at its other end which is fixed on the support to this support for displacement in a direction parallel to this supply tube. Thus the support and the supply tubes, as they thermally expand and contract, can move together in the same direction with the upright support posts extending between them being displaced both at their upper and lower ends. This arrangement completely eliminates any bending stresses in these support posts and allows the support posts to be connected up in the manner described in the above-cited copending application for cooling of these support posts.

According to further features of this invention the supply tube is supported at the lower end of each of the posts and at the lower end of the connector tube with a shoe which is displaceable on a fixed support. This shoe can be provided with rollers rotatable about horizontal axes transverse to the direction of expansion and contraction of the supply and the support tubes. Thus as these supply and support tubes heat up, and such heating is substantially the same in both tubes due to the relatively high rate of heat exchange between the cooling fluid passing through these tubes, the entire grate will expand longitudinally with both the upper and lower ends posts and connecting tube moving at the same rate in the same direction.

A plurality of such grate elements may be combined into a grate, with all of the support tubes lying generally in a common horizontal plane on which a workpiece to be treated is supported. Horizontally extending struts may be provided for laterally interconnecting adjacent grate element. Expansion and contraction in these struts, which are significantly shorter than the supply and the support tubes, is small enough that special precautions need not be taken to compensate for it.

It is also possible in accordance with this invention to provide two such grates, one of which is vertically and horizontally displaceable in its entirety relative to the other, traveling-beam fashion, for displacement of the workpiece through a treatment oven which may serve, for example, to anneal the workpiece.

Two such grate elements may be combined, so that in effect the middle of the combined element is fixed and the two ends can expand and contract away from and toward the fixed center.

Furthermore according to the instant invention the supply tube normally lies outside the oven and is, in fact, insulated so that the temperature difference between it and the support tube in the oven is minimized. Thus the connector tube and the post extend through a bottom wall of the oven. According to this invention the bottom wall is formed at each of these posts and at the support tube with a respective hole receiving the respective tube or post with clearance. This clearance is mainly in the direction of expansion and contraction of the grate element and is greater farthest from the fixed other end of the supply tube. Seals or cover plates are provided at these holes to prevent heat loss and escape of dust and hot gases from the interior of the oven.

SPECIFIC DESCRIPTION

Figure 1:
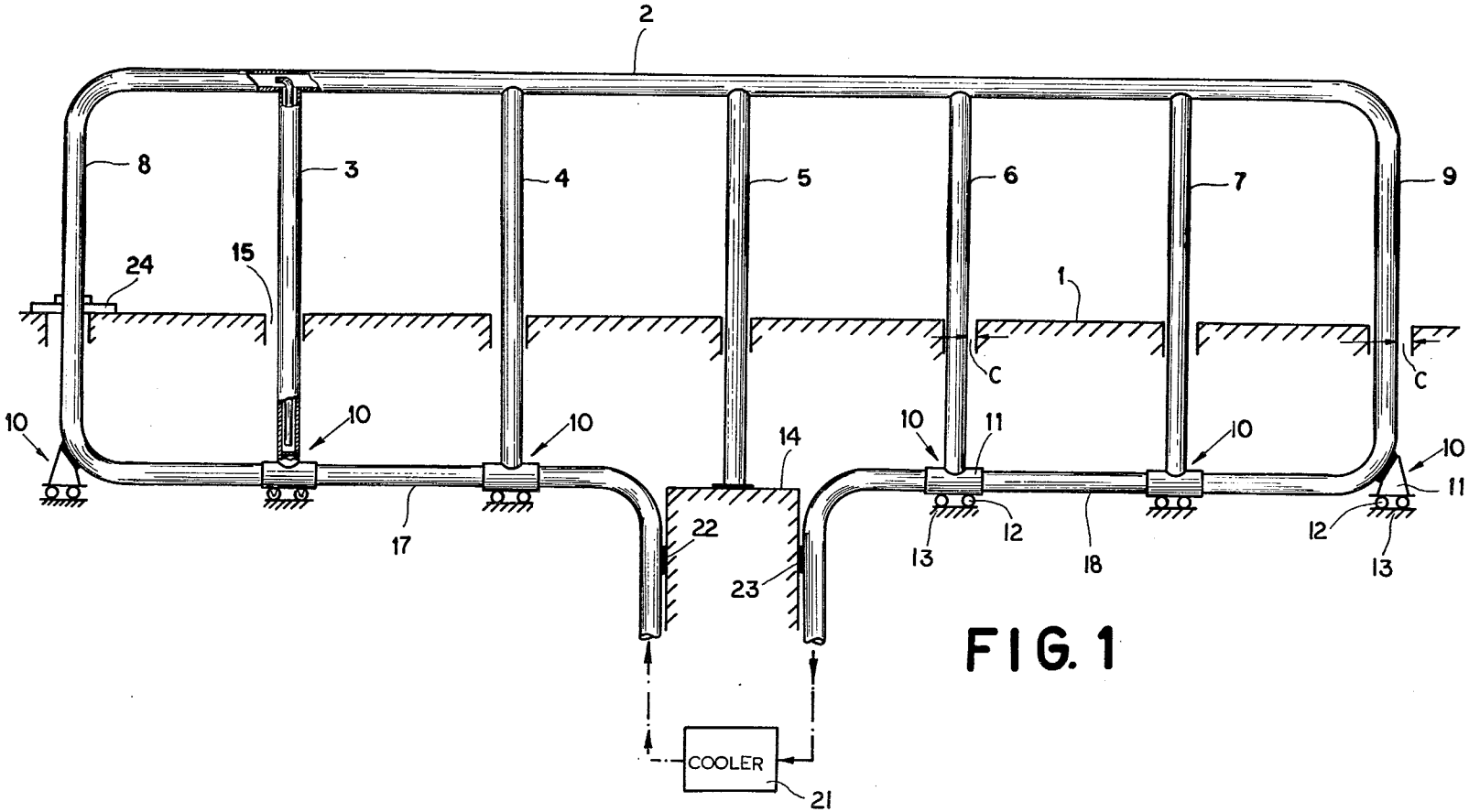
FIG. 1 is a side view of a double grate element according to the instant invention.

FIG. 1 shows a grate element usable in a metallurgical oven having a floor 1 of refractory material. The grate element basically comprises a horizontally and longitudinally extending upper support tube 2 connected at its upstream end to vertical connector tube 8 and its downstream end to a verticle connector tube 9. The lower ends of the upstream connector 8 is connected in turn to an input supply tube 17 extending parallel to and below the tube 2. The input supply tube 17 is in turn secured rigidly at 22 to a fixed support 14 and connected to the output side of a cooler 21. The other downstream connector tube 9 has its lower end similarly connected to an output supply tube 18 secured at 23 to the support 14 and connected to the other side of the cooler 21.

The support tube 2 is in turn supported via upright posts 3 and 4 on the supply tube 17, via similar post 6 and 7 on the supply tube 18, and via a central post 15 on the fixed support 14. These posts 3–7 are cooled in the manner described in the above-cited copending application, that is some of the flow through the tube 2 is diverted down through the centers of the post 7 and back up through them, but no flow goes directly into the top and out of the bottom of these posts 3–7. Fluid can only flow through the system from the tube 17 to the tube 8, then to the tube 2, and finally down through the tube 9, horizontally through the tube 18, and back into the cooler 21.

At the lower end of each of the posts 3–7 and of each of the connector tubes 8 and 9 there is provided a shoe 10 comprising a body 11 and rollers 12 that ride on a fixed support surface 13. Furthermore the oven floor 1 is formed at each of the posts 3–7 and at each of the connector tubes 8 and 9 with a vertically throughgoing hole 15 receiving a respective post or tube with a clearance C that is smallest at the central post 5 and greatest at the outer connector tubes 8 and 9. Seal plates such as shown at 24 on connector tube 8 overlie these holes 15 and prevent escape of gas or dust therethrough.

When in use the interior of the oven 1 is heated to a relatively high temperature, but a heat-exchange fluid, here steam, is circulated by the cooler 21 through the loop defined by the tubes 2, 8, 9, 17 and 18, as well as through posts 3–7 in the manner described in the above-cited application. Thus the entire grate element remains at substantially the same temperature, in spite of the difference in temperature between the interior of the oven where the upper parts of the post 3–7, the upper parts of the tubes 8 and 9, and the tube 2 are located, and the exterior of the oven with the rest of the grate element. Thermal expansion will therefore be mainly in the horizontal longitudinal direction of the grate element and can easily be compensated for by rolling of the rollers 12 on the support surfaces 13. Thus as the device heats up the shoes 10 will roll somewhat outwardly from the central fixed support 14, and vice versa when the grate cools down.

Figure 4:
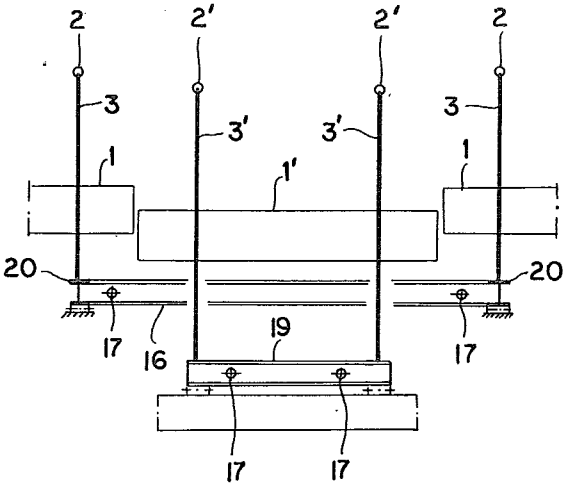
FIGS. 3 and 4 are sections taken in the direction of lines III—III and IV—IV of FIG. 2.
Figure 2:
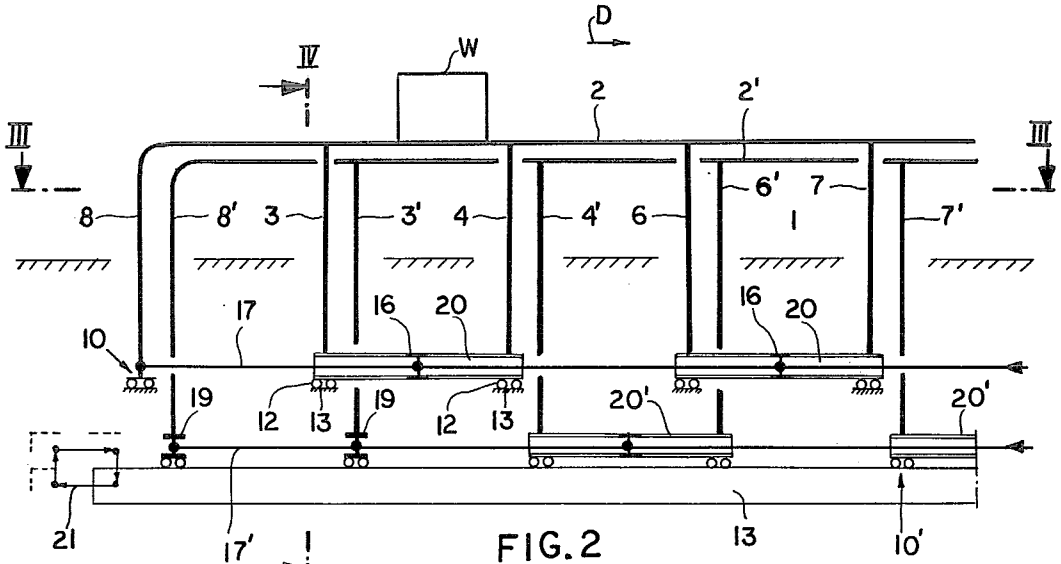
FIG. 2 is a partially schematic side view of a traveling-beam grate in accordance with this invention.
Figure 3:
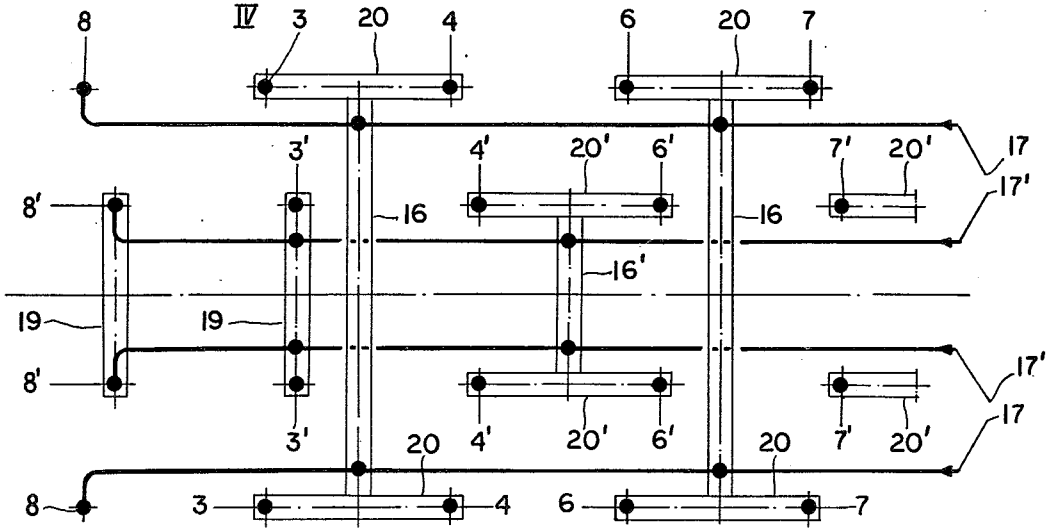

The arrangement of FIGS. 2–4 is functionally identical to that of FIG. 1, but shows how the various tubes and other structures of FIG. 1 can be employed in a traveling-beam support grate.

Thus two relatively fixed support tubes 2 flank two movable support tubes 2'. The fixed support tubes 2 are supported on posts 3–7 and have a connector tube 8 connected to an input supply tube 17. Similarly the movable or traveling support tubes 2' are supported on posts 3–7' and on a connector tube 8' in turn supported at their lower ends on an input supply tube 17'.

The posts 3 and 6 are each connected via a respective horizontally extending strut or beam 20 to the respective adjacent post 4 or 7. In addition each of the horizontally extending beams or struts 20 is connected to the opposite beam or strut 20 via a transverse beam or strut 16 forming an I-shaped structure. The input supply lines 17 are fixed to the transverse struts 16.

The lower end of each of the connector tubes 8' and each of the posts 3' are connected via a respective transverse beam or strut 19 to the opposite connector tube 8' or post 3'. The posts 4' and 6' are connected together via another I-shaped structure 16', 20' in the same manner as the posts 3 and 4, and a similar arrangement as provided for posts 7'. Here the input supply lines 17' are connected to the transverse beams 16' and 19. The shoes 10 ride on a fixed support 13 as in FIG. 1, but the shoes 10' of the tube 2' ride on a support 13' which can be displaced horizontally and vertically as indicated by the vector diagram 21. Thus it is possible for the tubes 2' to move above the plane of the tubes 2, then horizontally, drop down and move back in the opposite direction to displace a workpiece such as shown at W in FIG. 2 in direction D. The oven has a floor 1 a portion 1' of which can also move with the tubes 2'.

The system described in FIGS. 2–4 is otherwise identical in principle of operation to that of FIG. 1. Once again the connection of upper and lower ends of the posts and connector tubes to the support and supply tubes insures that these upper and lower ends will both be moved in the same direction at the same rate with thermal expansion and contraction of the grate element so that bending stresses will not be applied to these connector tubes or posts.

We claim:

1. A grate element comprising:

a horizontally elongated support tube having a pair of ends;

a fixed support;

a supply tube extending generally parallel to and underneath said support tube and having one end underneath one end of said support tube and another end fixed to said support;

a connector tube extending vertically between supply tube and said support tube at said one ends thereof, whereby said supply, connector, and support tubes form a circulation loop terminating at said other ends;

means for passing a heat-exchange fluid through said loop between said other ends thereof;

at least one upright post extending vertically between said support tube and said supply tube intermediate said ends thereof with said support tube supported by said post on said supply tube; and means supporting said supply tube except at said other end for displacement on said support in a direction parallel to said supply tube.

2. The element defined in claim 1 wherein said tubes are metallic and expansible thermally in said direction.

3. The element defined in claim 1 wherein the support means includes a shoe at the lower end of said post on said supply tube displaceable on said support.

4. The element defined in claim 3 wherein said support means includes rollers between said shoe and said support.

5. The element defined in claim 3 wherein another such shoe is provided at said one end of said supply tube.

6. A support grate comprising a plurality of the elements defined in claim 1 with said support tube defining a support surface and extending generally parallel to one another, said grate further comprising struts extending horizontally and transversely of said tubes between adjacent tubes.

7. The grate defined in claim 6 wherein the support means includes a shoe at the lower end of each of said posts on said supply tubes displaceable on said support, said struts extending horizontally between adjacent shoes.

8. The grate defined in claim 6, further comprising insulation between each of said supply tubes and the lower ends of the respective posts.

9. The grate defined in claim 6 wherein said grate is employed in an oven having a floor formed with throughgoing openings through which pass said connector tubes and posts, said openings being of greater diameter far from said other ends than close thereto.

10. The grate defined in claim 6 wherein said grate has two such supports, one of which is movable and carries some of said loops, said grate further comprising means for orbiting the movable support traveling-beam fashion relative to the other support.

* * * * *